US007571991B2

(12) United States Patent
Sugimoto

(10) Patent No.: US 7,571,991 B2
(45) Date of Patent: Aug. 11, 2009

(54) LIQUID EJECTION HEAD AND MANUFACTURING METHOD THEREOF

(75) Inventor: Shinya Sugimoto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 509 days.

(21) Appl. No.: 11/520,818

(22) Filed: Sep. 14, 2006

(65) Prior Publication Data

US 2007/0064062 A1 Mar. 22, 2007

(30) Foreign Application Priority Data

Sep. 16, 2005 (JP) ..... 2005-270878

(51) Int. Cl.
*B41J 2/045* (2006.01)

(52) U.S. Cl. ..... 347/68

(58) Field of Classification Search ..... 347/68, 347/69–70, 71–72; 29/25.35, 831, 846
See application file for complete search history.

(56) References Cited

U.S. PATENT DOCUMENTS 6,502,930 B1 * 1/2003 Shimada et al. ..... 347/71
7,380,318 B2 * 6/2008 Wada et al. ..... 29/25.35

FOREIGN PATENT DOCUMENTS

| | | | |
|---|---|---|---|
| JP | 6-134994 | A | 5/1994 |
| JP | 9-216368 | A | 8/1997 |
| JP | 10-44406 | A | 2/1998 |
| JP | 2003-34035 | A | 2/2003 |

* cited by examiner

*Primary Examiner*—K. Feggins
(74) *Attorney, Agent, or Firm*—Birch, Stewart, Kolasch & Birch, LLP

(57) ABSTRACT

The liquid ejection head includes: a first SOI substrate which has a first active layer, a first dielectric layer and a first supporting layer; a second SOI substrate which has a second active layer, a second dielectric layer and a second supporting layer, the second active layer being bonded to the first supporting layer; and a nozzle which is formed between the first supporting layer and the second dielectric layer, the nozzle ejecting liquid in an ejection direction perpendicular to a thickness direction of the first SOI substrate and the second SOI substrate, a cross-sectional width of the nozzle perpendicular to the ejection direction being defined by a thickness of the second active layer.

7 Claims, 12 Drawing Sheets

LIQUID EJECTION HEAD AND MANUFACTURING METHOD THEREOF

BACKGROUND OF THE INVENTION

1. Field of the Invention

The present invention relates to a liquid ejection head and a manufacturing method thereof, more particularly to a liquid ejection head comprising nozzles which eject liquid, and a manufacturing method thereof.

2. Description of the Related Art

A liquid ejection head has nozzles which eject droplets of ink toward a recording medium, such as paper. In the liquid ejection head, for example, it is known that by changing the volume of pressure chambers connected to the nozzles by means of actuators such as piezoelectric elements, through a diaphragm which constitutes one wall of the pressure chambers, the ink inside the pressure chambers is ejected from the nozzles.

The quality of the image formed on the recording medium by the liquid ejection head depends on variations in the ejection characteristics, such as the volume and ejection speed of the ink droplets ejected from the nozzles, and the like. The variations in the ejection characteristics are governed by variations in the dimensions of the sections relating to ejection, such as the nozzles.

On the other hand, a SOI (silicon on insulator) substrate having a structure in which a silicon layer is arranged on an insulating layer is known. There is a three-layer SOI substrate, in which a dielectric layer made of silica ($SiO_2$) or the like serving as an insulator is formed on a supporting layer made of silicon (Si), and an active layer made of silicon (Si) is arranged on the dielectric layer.

Japanese Patent Application Publication Nos. 6-134994 and 9-216368 disclose technology where etching is performed from both surfaces of a SOI substrate (namely, the outer surface of the active layer and the outer surface of the supporting layer), thereby forming two holes whose bases reach to the dielectric layer, in such a manner that the centers of the holes coincide with each other, whereupon a nozzle hole passing through the SOI substrate in the thickness direction is formed by etching the dielectric layer from the side of one of the holes having the smaller base diameter.

Japanese Patent Application Publication Nos. 10-44406 and 2003-34035 disclose technology where pressure chambers are formed by etching the supporting layer of a SOI substrate, and the active layer and the dielectric layer of the SOI substrate are used as a diaphragm.

Dimensional variations in the nozzles which affect the ejection characteristics include, for instance, variation in the length of the nozzle and variation in the cross-sectional area of the nozzle. In general, the flow resistance of a circular flow path is inversely proportional to the fourth power of the diameter of the flow path, and the flow resistance of a square flow path is inversely proportional to the third power of the cross-sectional area of the flow path. Therefore, it can be seen that especially strict control of the cross-sectional area of the nozzles is required.

In Japanese Patent Application Publication Nos. 6-134994 and 9-216368, in practice, the nozzle length is defined on the basis of the thickness of the active layer of the SOI substrate and/or the dielectric layer, but on the other hand, the reduction achieved in the variation of the cross-sectional area of the nozzles is limited.

If, for example, nozzles having a diameter of approximately several micrometers (μm) to several tens micrometers are formed so as to pass through the substrate by photolithography and etching, then in practice, it is only possible to reduce the variation in the nozzle diameter to approximately ±0.1 μm to ±0.5 μm.

Japanese Patent Application Publication Nos. 10-44406 and 2003-34035 do not discuss reduction of the variation in the nozzle dimensions.

SUMMARY OF THE INVENTION

The present invention has been contrived in view of the foregoing circumstances, an object thereof being to provide a liquid ejection head, and a method of manufacturing a liquid ejection head, whereby the variation in the cross-sectional area of the nozzles can be reduced and image quality can be improved.

In order to attain the aforementioned object, the present invention is directed to a liquid ejection head, comprising: a first SOI substrate which has a first active layer, a first dielectric layer and a first supporting layer; a second SOI substrate which has a second active layer, a second dielectric layer and a second supporting layer, the second active layer being bonded to the first supporting layer; and a nozzle which is formed between the first supporting layer and the second dielectric layer, the nozzle ejecting liquid in an ejection direction perpendicular to a thickness direction of the first SOI substrate and the second SOI substrate, a cross-sectional width of the nozzle perpendicular to the ejection direction being defined by a thickness of the second active layer.

According to the present invention, dimensional variations in the cross-sectional surface area of the nozzles are reduced, and hence variation in the ejection characteristics is reduced and image quality can be improved.

More specifically, looking at the first SOI substrate in an upper position with respect to the second SOI substrate, the upper wall faces of the nozzles are constituted by the supporting layer of the first SOI substrate, the lower wall faces of the nozzles are constituted by the dielectric layer of the second SOI substrate, and the width (height) of the nozzles in the vertical direction is defined by the thickness of the active layer of the second SOI substrate. Here, the error in the thickness of the active layer is generally small, approximately ±0.01 μm, due to the characteristics of the SOI substrates, and therefore the error of the active layer in the thickness direction can be ignored and the cross-sectional area of the nozzles becomes dependent only on the error of the active layer in the direction perpendicular to the thickness direction. In other words, the two-dimensional error in the magnitude is reduced to one-dimensional error in the magnitude. In other words, the error in the cross-sectional area of the nozzles can be reduced dramatically.

Preferably, the liquid ejection head further comprises: a pressure chamber which is formed in the first supporting layer and connects to the nozzle; a diaphragm which is constituted by the first active layer and the first dielectric layer; and a piezoelectric element which is fixed to the first active layer.

According to this aspect of the present invention, since the diaphragm is constituted by the active layer and the dielectric layer of the first SOI substrate, then the dimensional variation in the thickness of the diaphragm is restricted, due to the characteristics of the SOI substrates, and hence the variation in ejection characteristics is reduced and image quality can be improved.

Preferably, a plurality of substrate units each of which is composed of the first SOI substrate and the second SOI substrate are mutually bonded; and the second supporting layer is formed with a recess for protecting the piezoelectric element of adjacent one of the substrate units.

According to this aspect of the present invention, the supporting layer of the second SOI substrate of each substrate unit is formed with the recesses for protecting the piezoelectric elements of an adjacent substrate unit, and therefore it is possible to protect the piezoelectric elements, as well as obviating the need to provide a separate substrate for protecting the piezoelectric elements. Therefore, the nozzle pitch can be reduced in the thickness direction of the SOI substrate.

Preferably, the liquid ejection head further comprises a flow channel which is formed in the first supporting layer and supplies the liquid to the pressure chamber.

According to this aspect of the present invention, the flow channels which supply the liquid to the pressure chambers are formed, together with the pressure chambers, in the supporting layer of the first SOI substrate, and therefore it is not necessary to provide a separate substrate for supplying the liquid to the pressure chambers and hence the nozzle pitch in the thickness direction of the SOI substrate can be reduced.

In order to attain the aforementioned object, the present invention is also directed to an image forming apparatus, comprising the above-described liquid ejection head, and forming an image on a prescribed recording medium by ejecting the liquid containing coloring material onto the recording medium from the liquid ejection head.

In order to attain the aforementioned object, the present invention is also directed to a method of manufacturing a liquid ejection head, comprising: a SOI substrate preparation step of preparing a first SOI substrate having a first active layer, a first dielectric layer and a first supporting layer, and a second SOI substrate having a second active layer, a second dielectric layer and a second supporting layer; a nozzle formation step of forming a first recess in the second active layer by etching the second active layer using the second dielectric layer as an etch stop layer, the first recess corresponding to a nozzle which ejects liquid in an ejection direction and has a cross-sectional width perpendicular to the ejection direction being defined by a thickness of the second active layer; a pressure chamber formation step of forming a second recess in the first supporting layer using the first dielectric layer as an etch stop layer, the second corresponding to a pressure chamber which connects to the nozzle; and a bonding step of bonding the first supporting layer with the second active layer.

Preferably, the method further comprises, before the bonding step: a first liquid resistant layer formation step of forming a first liquid resistant layer on a liquid-contacting part of the first SOI substrate by one of sputtering and chemical vapor deposition; and a second liquid resistant layer formation step of forming a second liquid resistant layer on a liquid-contacting part of the second SOI substrate by one of sputtering and chemical vapor deposition.

According to the present invention, the first SOI substrate and the second SOI substrate are bonded together after carrying out a process for forming a liquid resistant layer on the liquid-contacting part of the first SOI substrate and the second SOI substrate, by sputtering or chemical vapor deposition, and therefore a liquid resistant layer having little variation in thickness can be formed by sputtering or chemical vapor deposition. In other words, it is possible to reduce the variation in the volume of the pressure chambers, nozzles, and the like, at the same time as ensuring the liquid resistant properties of the liquid-contacting part.

According to the present invention, it is possible to reduce the variation in the cross-sectional area of the nozzle, and hence image quality can be improved.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
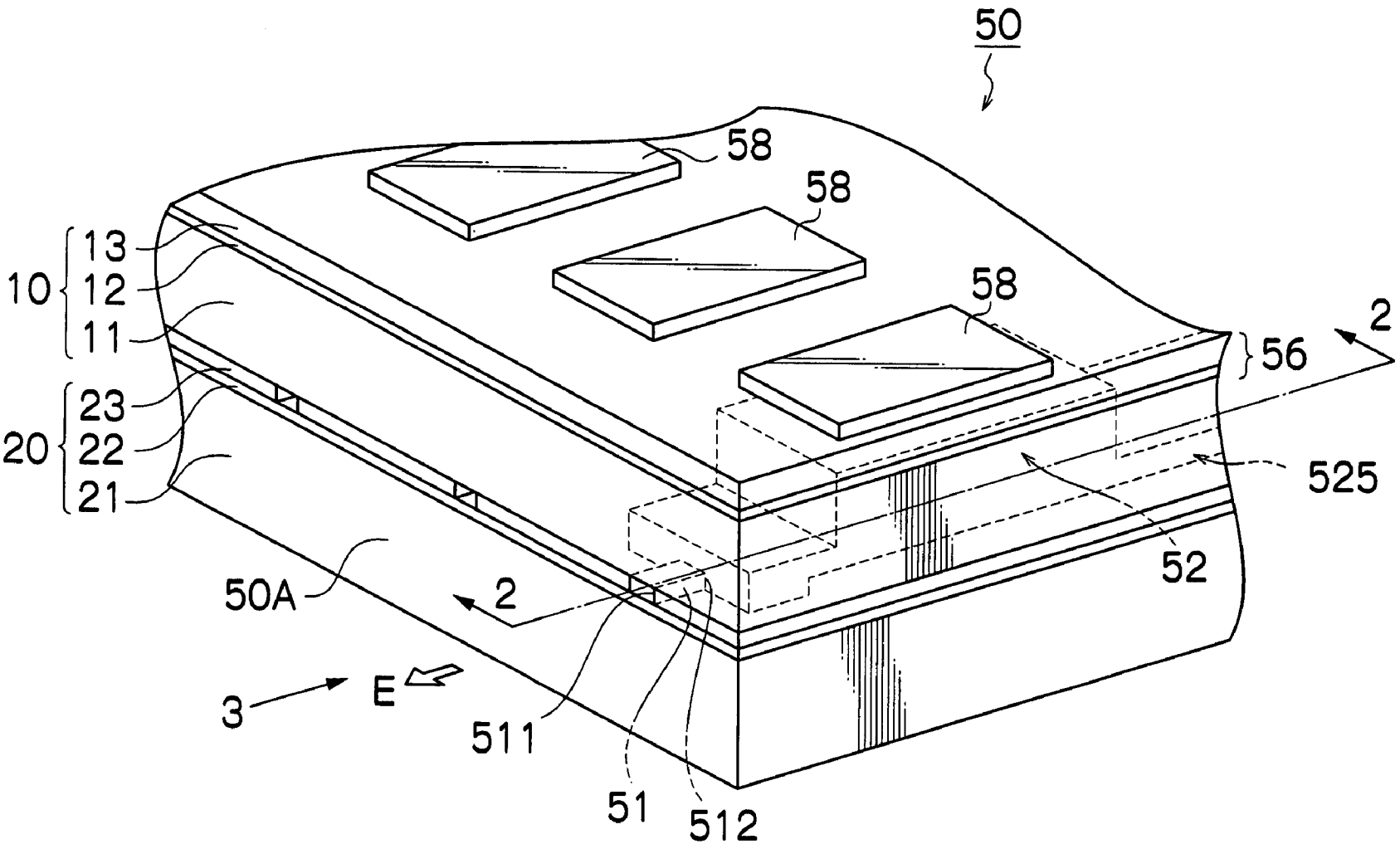
FIG. 1 is an oblique diagram showing the principal part of a liquid ejection head according to a first embodiment.
Figure 2:
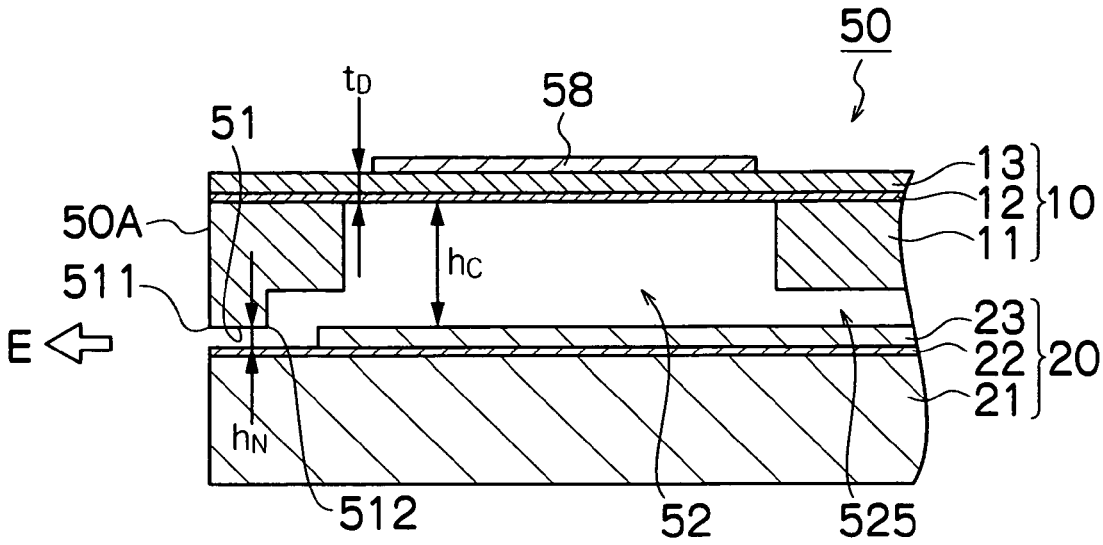
FIG. 2 is a cross-sectional diagram along line 2-2 in FIG. 1.
Figure 3:
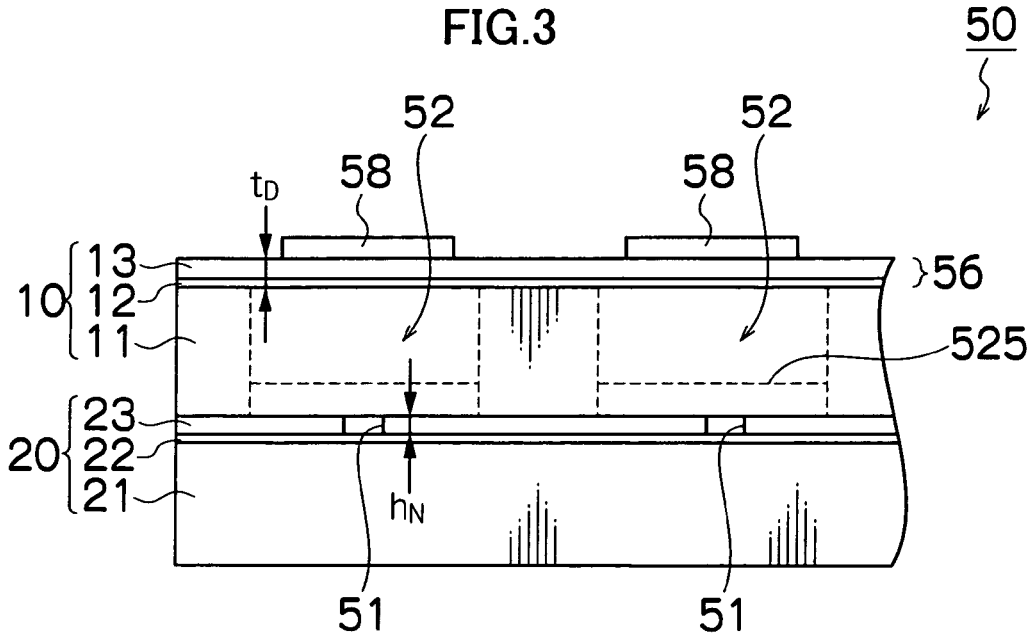
FIG. 3 is a cross-sectional diagram along line 3-3 in FIG. 1.

FIG. 1 is an oblique diagram showing the principal parts of a liquid ejection head 50 according to a first embodiment of the present invention. FIG. 2 is a cross-sectional diagram along line 2-2 in FIG. 1, and FIG. 3 is a side view observed in the direction of arrow 3 in FIG. 1.

The liquid ejection head 50 according to the first embodiment is laminated from at least two SOI (silicon on insulator) substrates.

The SOI substrate is a plate-shaped member in which a silicon layer is disposed on an insulating layer. More specifically, the SOI substrates 10 and 20 used in the present embodiment are three-layer substrates constituted by forming dielectric layers 12 and 22 made of silica ($SiO_2$) on supporting layers 11 and 21 made of silicon (Si), and then forming active layers 13 and 23 made of silicon (Si) on the dielectric layers 12 and 22, respectively.

In general, the thickness of the supporting layers 11 and 21 is several hundred micrometers (μm), and the thickness of the dielectric layers 12 and 22 and the active layers 13 and 23 is several tenths micrometers to several tens micrometers. Furthermore, in general, the dielectric layers 12 and 22 and the active layers 13 and 23 are formed with an extremely high accuracy of the thickness, with an error not exceeding ±0.01 μm.

The etching of silica forming the dielectric layers 12 and 22 progresses slowly compared to silicon forming the active layers 13 and 23, in other words, the etching rate of silica is lower than the etching rate of silicon. Therefore, the dielectric layers 12 and 22 are used as etch stop layers when forming nozzles 51 and pressure chambers 52 by etching, as described in detail below.

In FIGS. 1 to 3, the first SOI substrate 10 is bonded on the second SOI substrate 20. More specifically, the active layer 23 of the second SOI substrate 20 is bonded to the supporting layer 11 of the first SOI substrate 10. In other words, the liquid ejection head 50 is laminated from, sequentially from the bottom up in the drawings, the supporting layer 21 of the second SOI substrate 20, the dielectric layer 22 of the second SOI substrate 20, the active layer 23 of the second SOI substrate 20, the supporting layer 11 of the first SOI substrate 10, the dielectric layer 12 of the first SOI substrate 10, and the active layer 13 of the first SOI substrate 10.

FIGS. 1 to 3 show the liquid ejection head 50 in which the two SOI substrates 10 and 20 are mutually bonded, but it is also possible to dispose a plate member such as a further SOI substrate on the first SOI substrate 10 and/or below the second SOI substrate 20.

The liquid ejection head 50 laminated from the SOI substrates 10 and 20 in this way comprises: the nozzles 51, which eject liquid; pressure chambers 52, which connect 15 respectively to the nozzles 51; a diaphragm 56, which constitutes one wall of the pressure chambers 52; and piezoelectric elements 58, which are disposed on the side of the diaphragm 56 reverse to the side on which the pressure chambers 52 are formed, at positions corresponding to the pressure chambers 52.

The nozzles 51 are formed in the active layer 23 of the second SOI substrate 20, 20 between the supporting layer 11 of the first SOI substrate 10 and the dielectric layer 22 of the second SOI substrate 20. In other words, the nozzles 51 are formed in such a manner that the supporting layer 11 of the first SOI substrate 10 forms the upper surfaces thereof and the dielectric layer 22 of the second SOI substrate 20 forms the lower surfaces thereof, and the height of the nozzles $h_N$ (in other words, the width of the cross-section perpendicular to the ejection direction) is defined by the thickness of the active layer 23 of the second SOI substrate 20.

In the present embodiment, as shown in FIG. 3, the cross-sectional shape of the nozzles 51 is a rectangular shape, and the height $h_N$ corresponds to the length of the short edges, of the long and short edges that form this rectangular shape. The cross-sectional shape of the nozzles 51 is described here as being rectangular, for example, but it is not limited in particular to being a rectangular shape, and it may also be another quadrangular shape, as long as the width (height) of the nozzles 51 in the vertical direction is defined by the thickness of the active layer 23 of the second SOI substrate 20.

One end 511 of each nozzle 51 reaches to a nozzle surface 50A of the liquid ejection head 50, thereby forming an opening, and the other end 512 of each nozzle 51 connects to the pressure chamber 52, thereby forming a connection port.

The direction of ejection of the liquid ejected from the nozzles 51 (indicated by the arrow E in FIGS. 1 and 2) is perpendicular to the thickness direction of the SOI substrates 10 and 20, and hence the liquid ejection head 50 of a so-called "edge shooter" type is constituted.

The height $h_N$ of the nozzles 51 is defined to a uniform value in the direction of ejection. More specifically, as shown in FIG. 2, the height $h_N$ of the nozzle 51 is uniform at any place between the opening 511 and the connection port 512, and is equal to the thickness of the active layer 23 of the second SOI substrate 20.

By defining the height $h_N$ of the nozzles 51 to the uniform value through the lengthwise direction of the nozzles 51, by means of the thickness of the active layer 23, variation in the cross-sectional area between the nozzles 51 (including both dimensional errors between liquid ejection heads 50, and dimensional errors between the nozzles 51 in each liquid ejection head 50) is reduced, variation in the flow resistance of the nozzles 51 is reduced, and thus uniform ejection characteristics are obtained. Furthermore, the flow of the liquid in the nozzles 51 is stable, and the ejection state at the nozzles 51 also becomes stable.

The pressure chambers 52 are formed in the supporting layer 11 of the first SOI substrate 10, between the dielectric layer 12 of the first SOI substrate 10 and the active layer 23 of the second SOI substrate 20, and the height $h_C$ of the pressure chambers 52 is defined by the thickness of the supporting layer 11.

The height $h_C$ of the pressure chambers 52 is defined to a uniform value in the regions corresponding to the piezoelectric elements 58. More specifically, as shown in FIG. 2, the height $h_C$ of the pressure chambers 52 is the same as the thickness of the supporting layer 11 of the first SOI substrate 10, at least in the sections thereof directly below the piezoelectric elements 58. Here, by reducing the dimensional error in the thickness of the supporting layer 11 of the first SOI substrate 10 to the level that is substantially equal to the dimensional error in the thickness of the active layer 13 of the first SOI substrate 10, the height $h_C$ of the pressure chambers 52 is defined to the uniform value by the thickness of the supporting layer 11 of the first SOI substrate 10, and thus variation in the volume of the pressure chambers 52 can be reduced.

As well as the pressure chambers 52, flow channels 525 for supplying the liquid to the pressure chambers 52 are also formed in the supporting layer 11 of the first SOI substrate 10.

The diaphragm 56 is constituted by the active layer 13 and the dielectric layer 12 of the first SOI substrate 10.

The thickness $t_D$ of the diaphragm 56 is defined to a uniform value by the thickness of the active layer 13 of the first SOI substrate 10 and the thickness of the dielectric layer 12 of the first SOI substrate 10. By thus defining the thickness $t_D$ of the diaphragm 56 to the uniform value, variation in the actuator characteristics is reduced.

The piezoelectric elements 58 are fixed onto the surface of the active layer 13 of the first SOI substrate 10, on the opposite side to the pressure chambers 52.

FIGS. 4A to 4I are process diagrams showing a first embodiment of a manufacturing process for the liquid ejection head 50 shown in FIGS. 1 to 3.

Figure 4A:
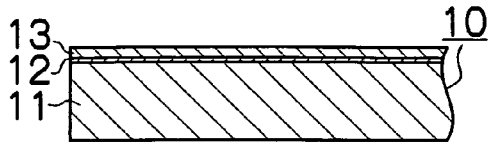
FIGS. 4A to 4I are process diagrams showing a first example of a manufacturing process for the liquid ejection head in FIG. 1.

As shown in FIG. 4A, the first SOI substrate 10 is prepared in which the dielectric layer 12 made of $SiO_2$ is formed on the supporting layer 11 made of Si, and the active layer 13 made of Si is provided on the dielectric layer 12. The second SOI substrate 20 is prepared in a similar fashion.

Figure 4B:
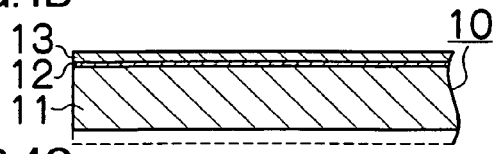

Thereupon, as shown in FIG. 4B, the outer surface (lower surface) of the supporting layer 11 of the first SOI substrate 10 is polished, in such a manner that the thickness of the supporting layer 11 of the first SOI substrate 10 becomes equal to the height $h_C$ of the pressure chambers 52 that are to be formed. By performing polishing in this fashion, it is possible to reduce the variation in the volume of the pressure chambers 52 formed by a subsequent etching process which uses the dielectric layer 12 of the first SOI substrate 10 as an etch stop layer. The polishing step may use mechanical polishing, chemical polishing, or chemical mechanical polishing. The error in the thickness of the supporting layer 11 after polishing is restricted to within ±0.01 μm of the target height $h_C$ of the pressure chambers 52.

Figure 4C:
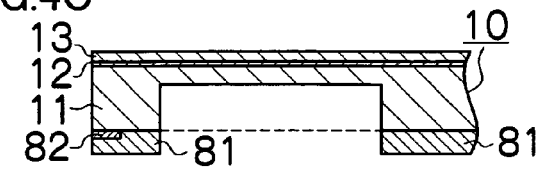

Next, as shown in FIG. 4C, mask patterns 81 and 82 for performing two-step etching, in other words, the first-step mask pattern 81 having openings corresponding to the pressure chambers 52 that are to be formed and the second-step mask pattern 82 corresponding to the pressure chambers 52 and the liquid supply flow channels 525 that are to be formed, are formed on the outer surface of the supporting layer 11 of the first SOI substrate 10, and first-step etching is carried out on the supporting layer 11 of the first SOI substrate 10, on the basis of the first-step mask pattern 81.

Here, in the first-step etching process, etching is carried out until an intermediate point of the thickness of the supporting layer 11 of the first SOI substrate 10.

Figure 4D:
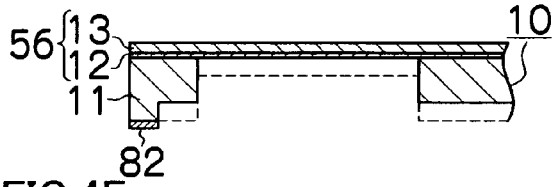

The first-step mask pattern 81 is then removed, and as shown in FIG. 4D, second-step etching is then carried out on the supporting layer 11 of the first SOI substrate 10, on the basis of the second-step mask pattern 82. In this second-step etching, the dielectric layer 12 of the first SOI substrate 10 is used as the etch stop layer, and etching is performed so as to pass through the supporting layer 11 of the first SOI substrate 10.

Figure 4E:
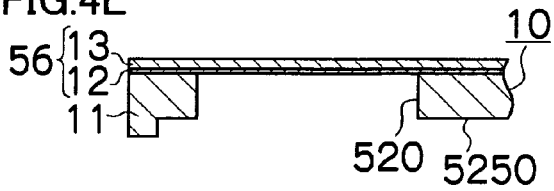

When the second-step mask pattern 82 is removed, as shown in FIG. 4E, the first SOI substrate 10 formed with recesses 520 corresponding to the pressure chambers 52 and recesses 5250 corresponding to the ink supply flow channels 525 is obtained. Here, the depth of the recesses 520 corresponding to the pressure chambers 52, in other words, the height of the pressure chambers 52 to be formed, is the same as the thickness of the supporting layer 11 of the first SOI substrate 10.

In the present embodiment, the first-step mask pattern 81 is formed on the outer surface of the supporting layer 11 of the first SOI substrate 10, in such a manner that it covers the second-step mask pattern 82. By previously forming the second-step mask pattern 82 in the state where the surface of the first SOI substrate 10 remains flat before carrying out the first-step etching in this way, it is possible to form the second-step mask pattern 82 readily to a high degree of accuracy. Alternatively, it is also possible to form the first-step mask pattern 81 on the outer surface of the supporting layer 11 of the first SOI substrate 10 and carry out the first-step etching, and to then remove the first-step mask pattern, form the second-step mask pattern 82 on the outer surface of the supporting layer 11 of the first SOI substrate 10, and then carry out the second-step etching.

Figure 4F:
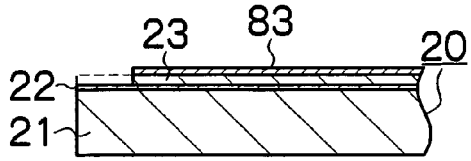

With respect to the second SOI substrate 20, as shown in FIG. 4F, a mask pattern 83 corresponding to the nozzles 51 to be created is formed on the outer surface (upper surface) of the active layer 23 of the second SOI substrate 20, and etching is performed on the active layer 23 of the second SOI substrate 20, on the basis of the mask pattern 83. Here, the dielectric layer 22 of the second SOI substrate 20 is used as an etch stop layer.

Figure 4G:
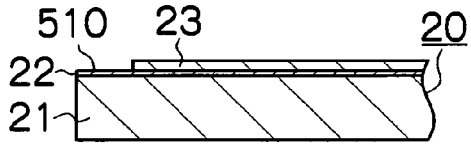

When the mask pattern 83 is removed, as shown in FIG. 4G, the second SOI substrate 20 formed with recesses 510 corresponding to the nozzles 51 is obtained. Here, the depth of the recesses 510 corresponding to the nozzles 51, in other words, the height of the nozzles 51 to be formed, is the same as the thickness of the active layer 23 of the second SOI substrate 20.

Figure 4H:
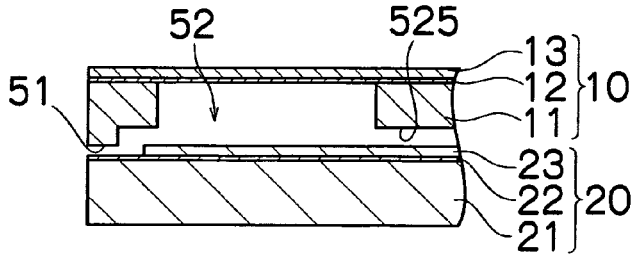

After carrying out processing of the first SOI substrate 10 and processing of the second SOI substrate 20 as described above, the first SOI substrate 10 and the second SOI substrate 20 are mutually bonded directly as shown in FIG. 4H. Here, the bonding may be carried out at room temperature, but desirably, bonding is carried out while applying both heat and pressure.

Thereupon, as shown in FIG. 41, the piezoelectric elements 58 are formed on the outer surface of the active layer 13 of the first SOI substrate 10.

Figure 4I:
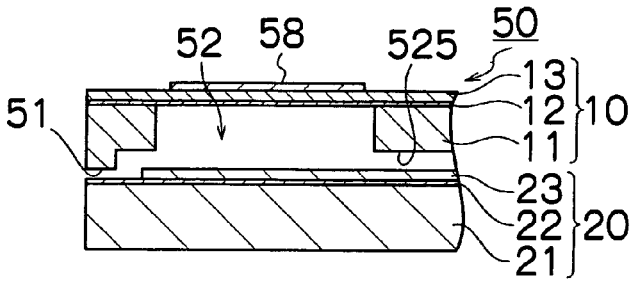

In this way, in the first embodiment, the recesses 520 corresponding to the pressure chambers 52 and the recesses 5250 corresponding to the liquid supply flow channels 525 are formed in the first SOI substrate 10 (see FIGS. 4A to 4E), the recesses 510 corresponding to the nozzles 51 are formed in the second SOI substrate 20 (see FIGS. 4F and 4G), the first SOI substrate 10 and the second SOI substrate 20 are bonded together, and the piezoelectric elements 58 are formed thereon (see FIGS. 4H and 4I). By forming piezoelectric elements 58 after bonding together the SOI substrates 10 and 20 in this way, excessive heat and pressure are not applied to the piezoelectric elements 58, and therefore the reliability of the piezoelectric elements 58 can be improved.

The etching for forming the pressure chambers 52 and the nozzles 51 may use a dry etching process or a wet etching process. In particular, when forming the recesses having the width of several micrometers to several tens micrometers, the length of several micrometers to several tens micrometers, and the depth of several micrometers to several hundred micrometers, at high density, it is desirable to use dry etching process to form these recesses having side walls of a substantially perpendicular shape.

FIGS. 5A to 5G are process diagrams showing a second embodiment of a manufacturing process for the liquid ejection head 50 shown in FIGS. 1 to 3.

Figure 5A:
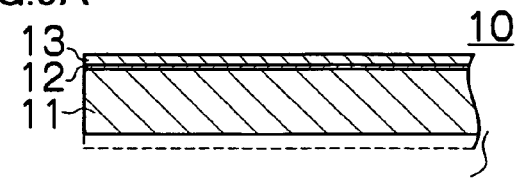
FIGS. 5A to 5G are process diagrams showing a second example of a manufacturing process for the liquid ejection head in FIG. 1.
Figure 5B:
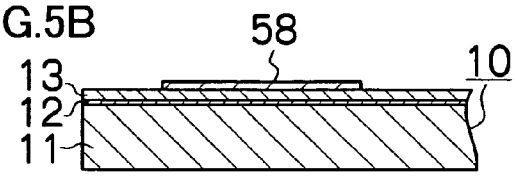
Figure 5C:
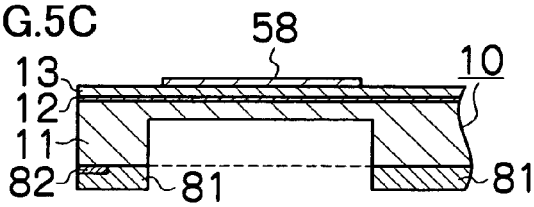
Figure 5D:
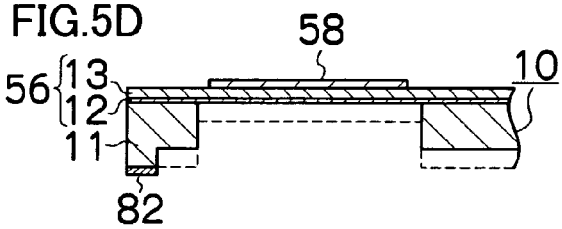
Figure 5E:
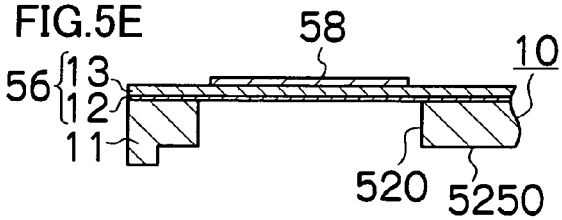
Figure 5F:
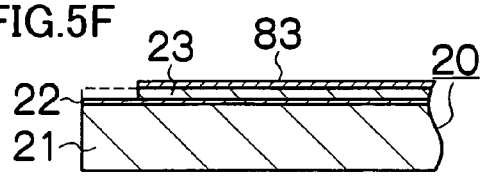
Figure 5G:
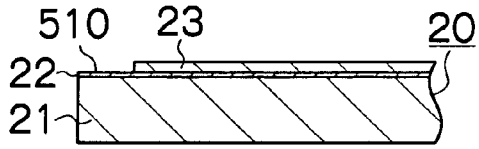

In the present embodiment, the piezoelectric elements 58 are formed on the outer surface of the active layer 13 of the first SOI substrate 10, as shown in FIGS. 5A and 5B, and the recesses 520 corresponding to the pressure chambers 52 and the recesses 5250 corresponding to the liquid supply flow channels 525 are formed in the first SOI substrate 10, as shown in FIGS. 5C to 5E, whereupon the first SOI substrate 10 is bonded with the second SOI substrate 20 that has been processed separately as shown in FIGS. 5F to 5G, thereby obtaining the liquid ejection head 50 shown in FIG. 2. Here, desirably, the bonding is carried out at room temperature.

By forming the piezoelectric elements 58 on the outer surface of the active layer 13 of the first SOI substrate 10 in this way, and then forming the recesses 520 below the piezoelectric elements 58, it is possible to prevent breakage of the diaphragm 56 caused by the stress during the formation of the piezoelectric elements 58.

FIGS. 6A to 6G are process diagrams showing a third embodiment of a manufacturing process for the liquid ejection head 50 shown in FIGS. 1 to 3.

Figure 6A:
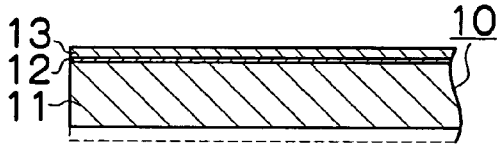
FIGS. 6A to 6G are process diagrams showing a third example of a manufacturing process for the liquid ejection head in FIG. 1.
Figure 6B:
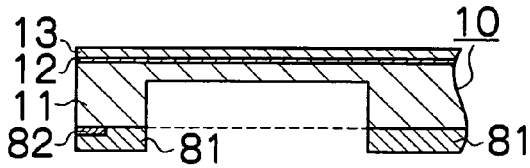
Figure 6C:
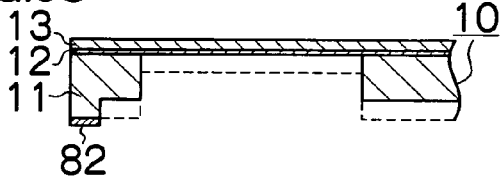
Figure 6D:
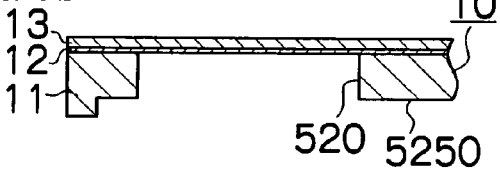
Figure 6E:
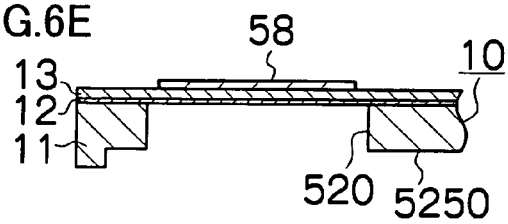
Figure 6F:
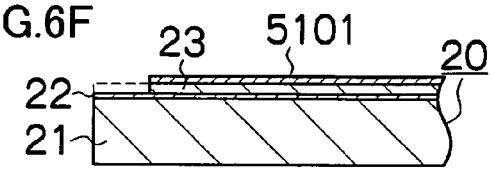
Figure 6G:
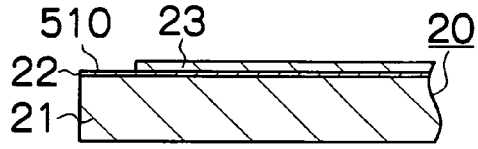

In the present embodiment, the recesses 520 corresponding to the pressure chambers 52 and the recesses 5250 corresponding to the liquid supply flow channels 525 are formed in the first SOI substrate 10, as shown in FIGS. 6A to 6D, and the piezoelectric elements 58 are then formed on the outer surface of the active layer 13 of the first SOI substrate 10, as shown in FIG. 6E, whereupon the first SOI substrate 10 is bonded with the second SOI substrate 20 that has been processed separately as shown in FIGS. 6F to 6G, thereby obtaining the liquid ejection head 50 shown in FIG. 2. Here, desirably, the bonding is carried out at room temperature.

Figure 7:
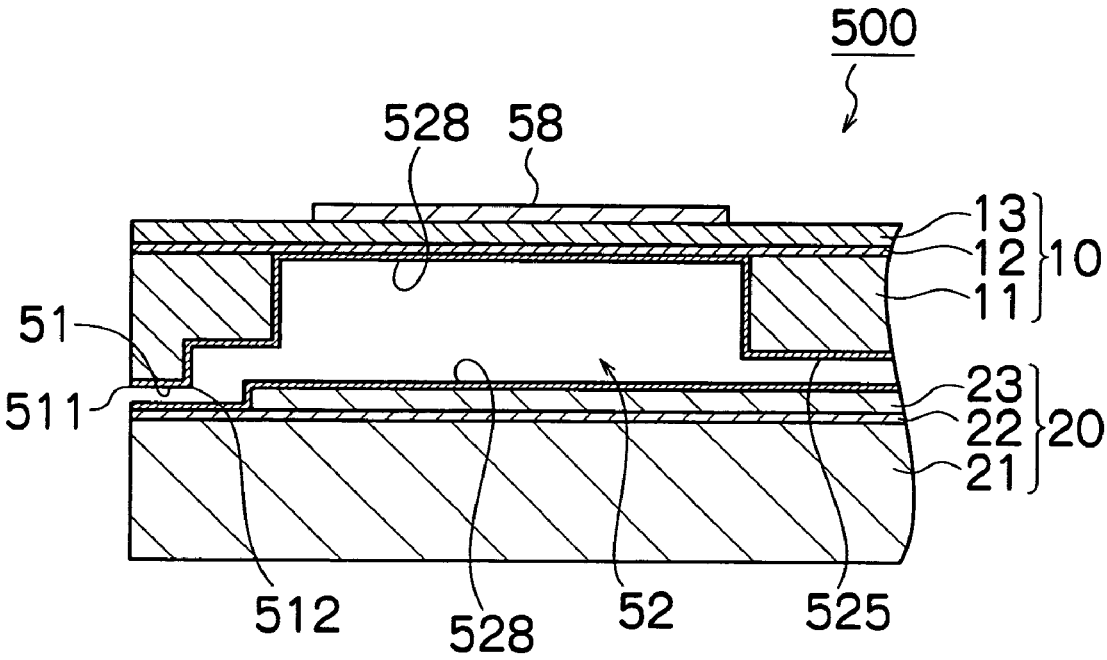
FIG. 7 is a cross-sectional diagram showing the principal section of a liquid ejection head according to a second embodiment, which is provided with liquid resistant layers.

FIG. 7 is a cross-sectional diagram showing the principal part of a liquid ejection head 500 according to a second embodiment, in which a liquid resistant layer 528 is formed on the surfaces of the nozzles 51, the pressure chambers 52 and the liquid supply flow channels 525 of the liquid ejection head 50 shown in FIGS. 1 to 3.

The liquid resistant layer 528 is formed before the step of mutually bonding the first SOI substrate 10 and the second SOI substrate 20.

Figure 8A:
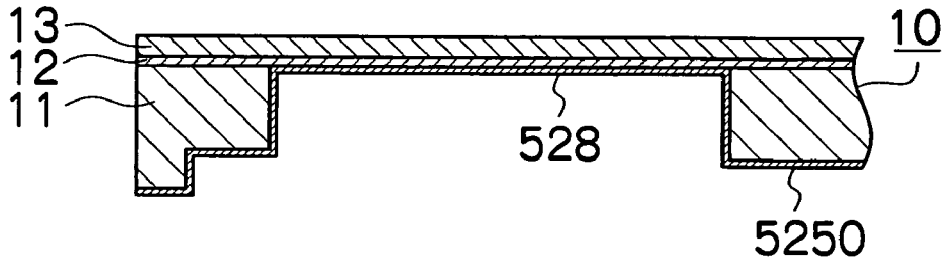
FIGS. 8A to 8C are process diagrams used to describe one example of a method of manufacturing the liquid ejection head in FIG. 7.

For example, the liquid resistant layer 528 is formed by sputtering or chemical vapor deposition (CVD) as shown in FIG. 8A, on the liquid-contacting part of the first SOI substrate 10, which is formed with the recesses 520 corresponding to the pressure chambers 52 and the recesses 5250 corresponding to the liquid supply flow channels 525, as shown in FIGS. 4A to 4E.

Figure 8B:
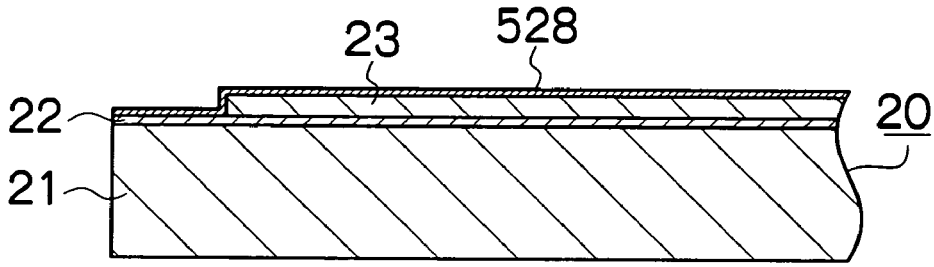

On the other hand, the liquid resistant layer 528 is formed by sputtering or CVD, as shown in FIG. 8B, on the liquid-contacting part of the second SOI substrate 20 formed with the recesses 510 corresponding to the nozzles 51, as shown in FIGS. 4F and 4G.

Figure 8C:
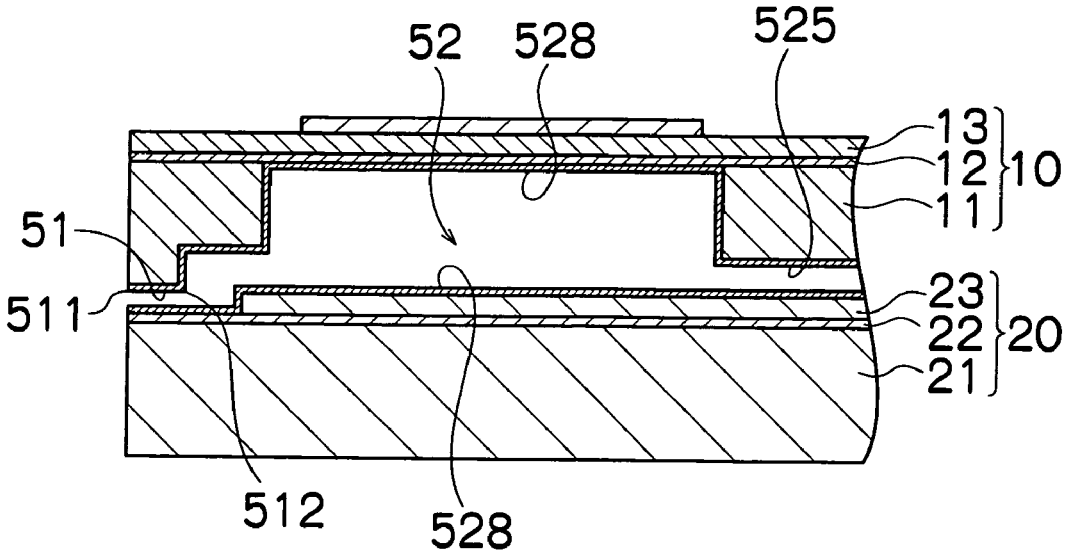

After forming the liquid resistant layers 528 on the liquid-contacting part of the first SOI substrate 10 and the liquid-contacting part of the second SOI substrate 20, by sputtering or CVD, the supporting layer 11 of the first SOI substrate 10 and the active layer 23 of the second SOI substrate 20 are mutually bonded as shown in FIG. 8C. Thereupon, the piezoelectric elements 58 are formed on the outer surface of the active layer 13 of the first SOI substrate 10, thereby the liquid ejection head 500 shown in FIG. 7 is obtained.

Since the liquid resistant layer 528 is deposited by sputtering or CVD in this way, before bonding the first SOI substrate 10 with the second SOI substrate 20, in a state where the liquid-contacting part are exposed, then it is possible to reduce variations in the thickness of the liquid resistant layer 528, and it is possible to ensure liquid resistance of the liquid-contacting parts while reducing variation in the ejection characteristics of the nozzles 51 and variation in the volume of the pressure chambers 52.

Generally, the error in the thickness of the liquid resistant layer 528 can be restricted to approximately ±0.01 μm, if it is formed by sputtering or CVD.

The height $h_N$ of the nozzles 51 is expressed as $h_N=t_{2A}-(t_{1R}+t_{2R})$, where $t_{2A}$ is the thickness of the active layer 23 of the second SOI substrate 20, $t_{1R}$ is the thickness of the liquid resistant layer 528 on the first SOI substrate 10, and $t_{2R}$ is the thickness of the liquid resistant layer 528 on the second SOI substrate 20.

Even when the liquid resistant layer 528 is provided in this way, since the variations in the thicknesses $t_{1R}$ and $t_{2R}$ of the liquid resistant layer 528 can be fixed by forming the liquid resistant layer 528 by sputtering or CVD, then the height $h_N$ of the nozzles 51 is dependent on the thickness $t_{2A}$ of the active layer 23 of the second SOI substrate 20, and therefore the height $h_N$ of the nozzles 51 can be still regarded as being defined by the thickness $t_{2A}$ of the active layer 23.

The thickness $t_D$ of the diaphragm is expressed as $t_D=t_{1A}+t_{1B}+t_{1R}$, where $t_{1A}$ is the thickness of the active layer 23 of the first SOI substrate 10, $t_{1B}$ is the thickness of the dielectric layer 22 of the first SOI substrate 10, and $t_{1R}$ is the thickness of the liquid resistant layer 528 on the first SOI substrate 10.

The height $h_C$ of the pressure chambers 52 is expressed as $h_C=t_{1H}-(t_{1R}+t_{2R})$, where $t_{1H}$ is the thickness of the supporting layer 11 of the first SOI substrate 10, $t_{1R}$ is the thickness of the liquid resistant layer 528 of the first SOI substrate 10, and $t_{2R}$ is the thickness of the liquid resistant layer 528 of the second SOI substrate 20.

Figure 9:
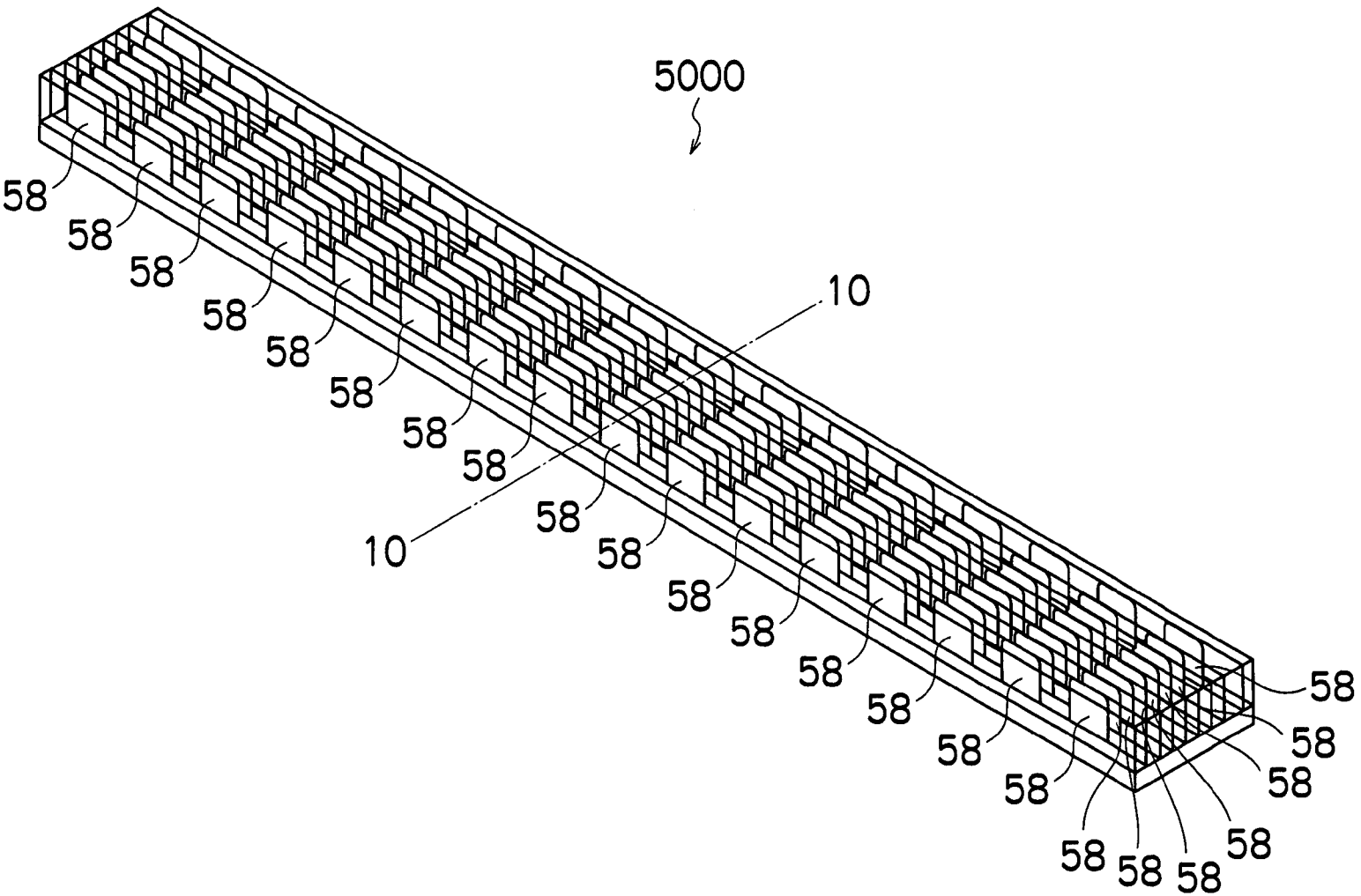
FIG. 9 is an oblique diagram showing one example of the general structure of a liquid ejection head according to a third embodiment.

FIG. 9 is an oblique perspective diagram showing one embodiment of the general structure of a liquid ejection head 5000 according to a third embodiment.

As shown by the transparent view in FIG. 9, the piezoelectric elements 58 are arranged in a two-dimensional matrix configuration. Similarly, the nozzles 51 and the pressure chambers 52 (not shown in FIG. 9) are arranged in a two-dimensional matrix configuration. In other words, the liquid ejection head 5000 according to the third embodiment is formed as a so-called two-dimensional matrix type of liquid ejection head.

Figure 10:
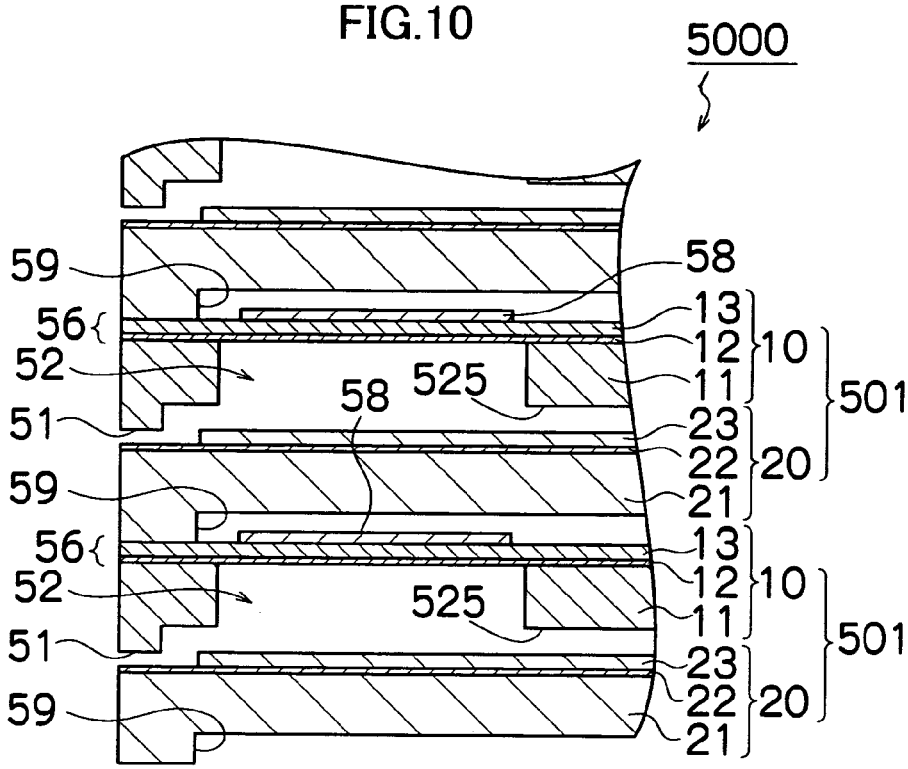
FIG. 10 is a cross-sectional diagram along line 10-10 in FIG. 9.

In order to show a clear view of the concrete internal structure of the two-dimensional matrix type of liquid ejection head 5000, FIG. 10 shows a principal cross-sectional diagram along line 10-10 in FIG. 9. In FIG. 10, constituent elements which are the same as the constituent elements of the liquid ejection head 50 of the first embodiment shown in FIGS. 1 to 3 are denoted with the same reference numerals, and elements which have already been described above are not described further here.

In FIG. 10, the liquid ejection head 5000 according to the third embodiment is laminated from a plurality of substrate units 501 in the thickness direction of the SOI substrates 10 and 20, where each of the substrate units 501 is composed of the first SOI substrate 10 and the second SOI substrate 20.

The nozzles 51, the pressure chambers 52 and the piezoelectric elements 58 are arranged respectively following the vertical direction in FIG. 10, in other words, the direction along the line 10-10 in FIG. 9.

Furthermore, the nozzles 51, the pressure chambers 52 and the piezoelectric elements 58 are arranged respectively from the near side toward the far side in FIG. 10, in other words, following the direction perpendicular to the line 10-10 in FIG. 9.

In each of the substrate units 501, the supporting layer 21 of the second SOI substrate 20 is formed with a recess-shaped actuator protecting section 59, which protects the piezoelectric element 58 in the adjacent substrate unit 501 on the lower side. By accommodating the piezoelectric elements 58 inside the recess-shaped actuator protecting sections 59, the piezoelectric elements 58 are separated from the liquid-contacting sections inside the SOI substrates 10 and 20 (more specifically, the nozzles 51, the pressure chambers 52 and the liquid supply flow channels 525) in such a manner that the piezoelectric elements 58 do not make contact with the liquid. Furthermore, by providing a space about the periphery of each of the piezoelectric elements 58, the displacement operation of the piezoelectric elements 58 is guaranteed, and hence the reliability of the piezoelectric elements 58 is improved.

Since the actuator protecting sections 59 are formed in the supporting layers 21 of the second SOI substrates 20, then it is not necessary to provide special substrates for protecting the piezoelectric elements 58. Furthermore, since the liquid supply flow channels 525 supplying the liquid to the pressure chambers 52 are formed in the supporting layers 11 of the first SOI substrates 10, as well as the pressure chambers 52, then it is not necessary to provide special substrates for forming the flow channels supplying the liquid to the pressure chambers 52.

Since the number of substrates is thus minimized, then it is possible to reduce the interval (nozzle pitch) between the nozzles 51 in the direction of lamination of the SOI substrates 10 and 20 (the thickness direction). Furthermore, since it is possible to reduce the nozzle pitch, the width of the liquid ejection head 5000 in the direction of lamination can also be reduced, and therefore, the conveyance of the recording medium with respect to the nozzles 51 is facilitated, in other words, it becomes easier to pass the recording medium below the liquid ejection head 5000. Furthermore, since it is possible to reduce the nozzle pitch, it also becomes possible to reduce the deviation in the landing positions of droplets of the liquid ejected from the nozzles by shortening the distance between the openings of the nozzles 51 and the recording surface of the recording medium. Therefore, it is possible to record images of high quality.

Furthermore, by reducing the variations in the thicknesses of the SOI substrates 10 and 20, the variation in the nozzle pitch is reduced in the lamination direction of the SOI substrates 10 and 20 (the thickness direction), and hence the deviation in the landing positions is further reduced.

Figure 11:
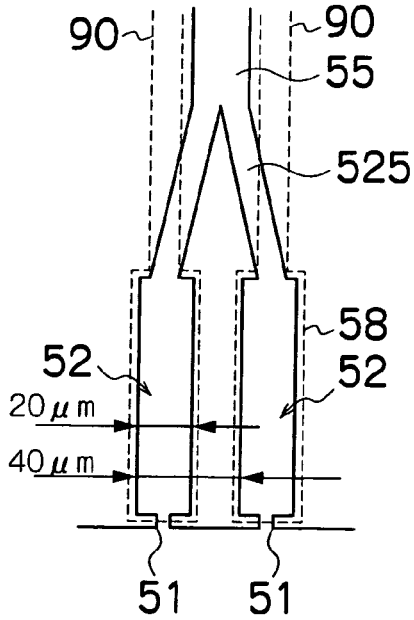
FIG. 11 is a cross-sectional diagram showing a liquid ejection head according to the third embodiment as viewed in the medium conveyance direction.

FIG. 11 is a principal cross-sectional diagram of the liquid ejection head 5000 along a line perpendicular to the line 10-10 in FIG. 9.

In FIG. 11, a common flow channel 55 forming a main channel is in connection with the liquid supply flow channels 525, which form distributary channels connecting respectively to the pressure chambers 52. The liquid is supplied from a liquid tank (not shown) through the common flow channel 55 and the liquid supply flow channels 525 to the pressure chambers 52.

The piezoelectric elements 58 are connected with drive wires 90, through which electrical signals (drive signals) are applied to the piezoelectric elements 58. The drive wires 90 are formed on the diaphragm 56, together with the piezoelectric elements 58, and hence the drive wires 90 can be separated from the liquid-contacting parts (more specifically, the nozzles 51, the pressure chambers 52, and the liquid supply flow channels 525) by means of the active layers 13 of the first SOI substrates 10 and the supporting layers 21 of the second SOI substrates 20, which constitute the walls of the actuator protecting sections 59. Therefore, the reliability of the electrical connections is improved. When a prescribed drive signal is applied to the piezoelectric element 58 through the drive wire 90, then a displacement occurs in the piezoelectric element 58 and the diaphragm 56 constituted by the active layer 13 and the dielectric layer 12 of the first SOI substrate 10 is caused to vibrate, thereby changing the volume of the pressure chamber 52 and causing the liquid to be ejected from the nozzle 51.

For example, if the width of the pressure chambers 52 is approximately 20 μm, and the interval between the pressure chambers 52 is approximately 40 μm, then the nozzle pitch is approximately 40 μm. In general, it is possible to arrange the nozzles 51 at a density of 200 npi (nozzles per inch) to 600 npi. Therefore, in the two-dimensional matrix head that has the nozzles 51 arranged in the two-dimensional configuration, it is possible to ensure that any positional displacement that may occur in the installation positions of the nozzles 51 between the nozzle rows is separated from the visible spatial frequency regions, and hence the displacement in the nozzle positions between the nozzle rows can be tolerated in this composition.

Furthermore, it is possible to reduce the total number of substrates that are bonded together to form the liquid ejection head 5000. For example, if 1200 npi is achieved in the liquid ejection head 5000 as a whole, then provided that an actual nozzle pitch of 600 npi is achieved in each of the substrate units 501, the two (=1200/600) sets of substrate units 501 are sufficient, and the total number of SOI substrates required is only four (=2×2).

FIGS. 12A to 12I are process diagrams showing an embodiment of a manufacturing process for the liquid ejection head 5000 according to third embodiment shown in FIGS. 9 to 11.

Firstly, the required number of SOI substrates 10 and 20 are prepared. More specifically, taking N to be the number of nozzles 51 formed in the thickness direction of the SOI substrates 10 and 20 (the direction along the line 10-10 in FIG. 9), then 2×N substrates are prepared.

In FIGS. 12A to 12I, only one of the substrate units 501 is depicted.

The various steps of the processing sequence for the first SOI substrate 10 shown in FIGS. 12A to 12E are substantially the same as the steps of the second embodiment of the manufacturing process shown in FIGS. 5A to 5E for the liquid ejection head 50 according to the first embodiment.

Figure 12A:
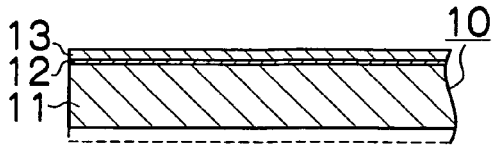
FIGS. 12A to 12I are process diagrams showing one example of a manufacturing process for the liquid ejection head in FIG. 10.
Figure 12B:
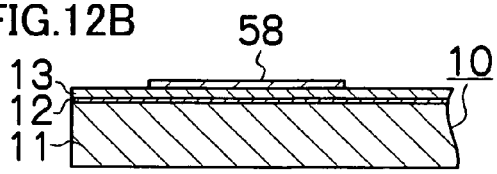
Figure 12C:
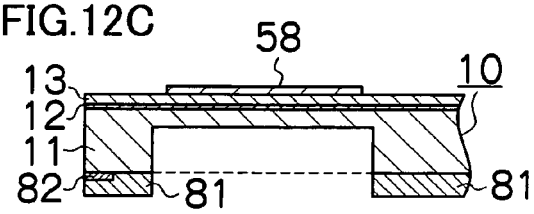
Figure 12D:
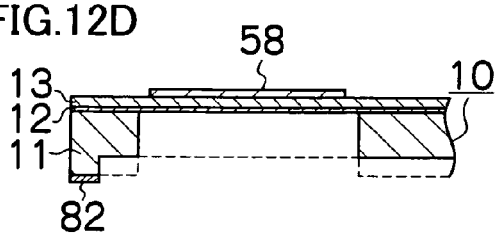
Figure 12E:
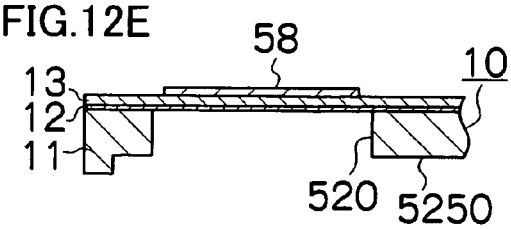
Figure 12F:
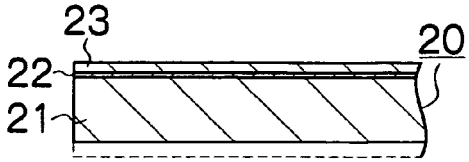

In the polishing steps shown in FIGS. 12A and 12F, the thicknesses of the supporting layers 11 and 21 of the SOI substrates 10 and 20 are adjusted in such a manner that the total of the thickness of the first SOI substrate 10 and the thickness of the second SOI substrate 20 is the same as the nozzle pitch in the thickness direction of the SOI substrates 10 and 20.

The thickness variation of the supporting layers 11 and 21 of the SOI substrates 10 and 20 prepared as starting materials, in other words, the thickness variation of the supporting layers 11 and 21 before polishing, is generally hundreds to a few thousand times as large as the thickness variation in the active layers 13 and 23 and the thickness variation in the dielectric layers 12 and 22. The thickness variation of SOI substrates in 4-inch-diameter wafers is generally 500 μm to 525 μm, between substrates or lots. In the liquid ejection head 5000 having the nozzles 51 arranged in the two-dimensional matrix configuration, if there is variation in the thickness of the supporting layers 11 and 21, then positional variation of the nozzles 51 arises in the thickness direction of the SOI substrates 10 and 20, and it becomes impossible to form high-quality images, due to the resulting landing position displacement in the ejected liquid droplets. Therefore, the thickness variation in the supporting layers 11 and 21 is reduced in advance by mechanical polishing, chemical polishing, or chemical mechanical polishing.

Besides a mode in which the piezoelectric elements 58 are formed on the outer surface of the active layer 13 of the first SOI substrate 10 as shown in FIG. 12B and the recesses 520 and 5250 are then formed in the first SOI substrate 10 as shown in FIGS. 12C to 12E, a mode is also possible in which the recesses 520 and 5250 are formed in the first SOI substrate 10 and the piezoelectric elements 58 are then formed in the outer surface of the active layer 13 of the first SOI substrate 10.

As shown in FIG. 12C, the mask patterns 81 and 82 for performing the two-step etching, in other words, the first-step mask pattern 81 having openings corresponding to the pressure chambers 52 that are to be formed and the second-step mask pattern 82 corresponding to the pressure chambers 52 and the liquid supply flow channels 525 that are to be formed, are formed on the outer surface of the supporting layer 11 of the first SOI substrate 10, and the first-step etching is carried out on the supporting layer 11 of the first SOI substrate 10, on the basis of the first-step mask pattern 81. Here, in the first-step etching process, etching is carried out until an intermediate point of the thickness of the supporting layer 11 of the first SOI substrate 10. The first-step mask pattern 11 is then removed, and as shown in FIG. 12D, the second-step etching is then carried out on the supporting layer 11 of the first SOI substrate 10, on the basis of the second-step mask pattern 82.

In this second-step etching, the dielectric layer 12 of the first SOI substrate 10 is used as the etch stop layer, and etching is performed so as to pass through the supporting layer 11 of the first SOI substrate 10. When the second-step mask pattern 82 is removed, as shown in FIG. 12E, the first SOI substrate 10 formed with the recesses 520 corresponding to the pressure chambers 52 and the recesses 5250 corresponding to the ink supply flow channels 525 is obtained. Here, the depth of the recesses 520 corresponding to the pressure chambers 52, in other words, the height of the pressure chambers 52 to be formed, is the same as the thickness of the supporting layer 11 of the first SOI substrate 10.

Figure 12G:
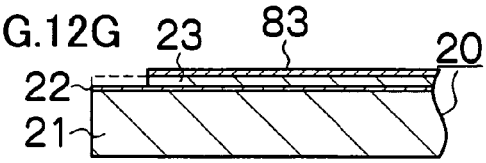

As shown in FIG. 12G, after the polishing step shown in FIG. 12F, the mask pattern 83 corresponding to the nozzles 51 to be created is formed on the outer surface (upper surface) of the active layer 23 of the second SOI substrate 20, and etching is performed on the active layer 23 of the second SOI substrate 20, on the basis of this mask pattern 83. Thereupon, the mask pattern 83 is removed.

Figure 12H:
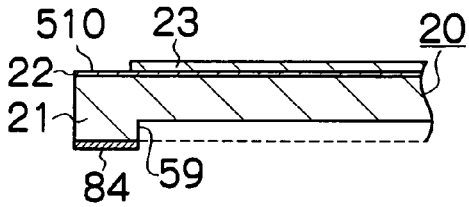

Next, as shown in FIG. 12H, a mask pattern 84 corresponding to the actuator protecting sections 59 is formed on the outer surface of the supporting layer 21 of the second SOI substrate 20, and etching is carried out on the supporting layer 21 of the second SOI substrate 20 on the basis of the mask pattern 84, whereupon the mask pattern 84 is removed.

Figure 12I:
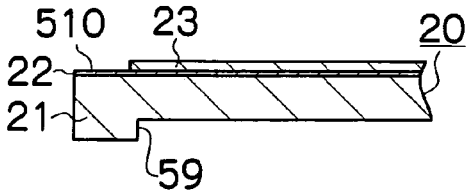

In so doing, the second SOI substrate 20 formed with the recesses 510 corresponding to the nozzles 51 and the actuator protecting sections 59 is obtained, as shown in FIG. 12I.

After carrying out the processing steps for the first SOI substrate 10 shown in FIGS. 12A to 12E, and the processing steps for the second SOI substrate 20 shown in FIGS. 12F to 12I, the SOI substrates 10 and 20 are mutually bonded, thereby obtaining the liquid ejection head 5000 in which the substrate units 501 are arranged in the thickness direction of the SOI substrates 10 and 20.

More specifically, in each of the substrate units 501, the supporting layer 11 of the first SOI substrate 10 is bonded to the active layer 23 of the second SOI substrate 20. In this bonding step, the positions are adjusted in such a manner that the nozzles 51 become in connection with the pressure chambers 52. Furthermore, between the substrate units 501, the supporting layer 21 of the second SOI substrate 20 in an n-th substrate unit 501 is bonded to the active layer 13 of the first SOI substrate 10 in the adjacent, (n+1)-th substrate unit 501. In this bonding step, the positions are adjusted in such a manner that the piezoelectric elements 58 become accommodated within the recess-shaped actuator protecting sections 59.

In the method of manufacture shown in FIGS. 12A to 12I, desirably, the bonding of the SOI substrates is carried out at room temperature. For example, the bonding is carried out by activating the bonding surfaces in a vacuum, and then applying pressure to the bonding surfaces by using a pressing jig.

Figure 13:
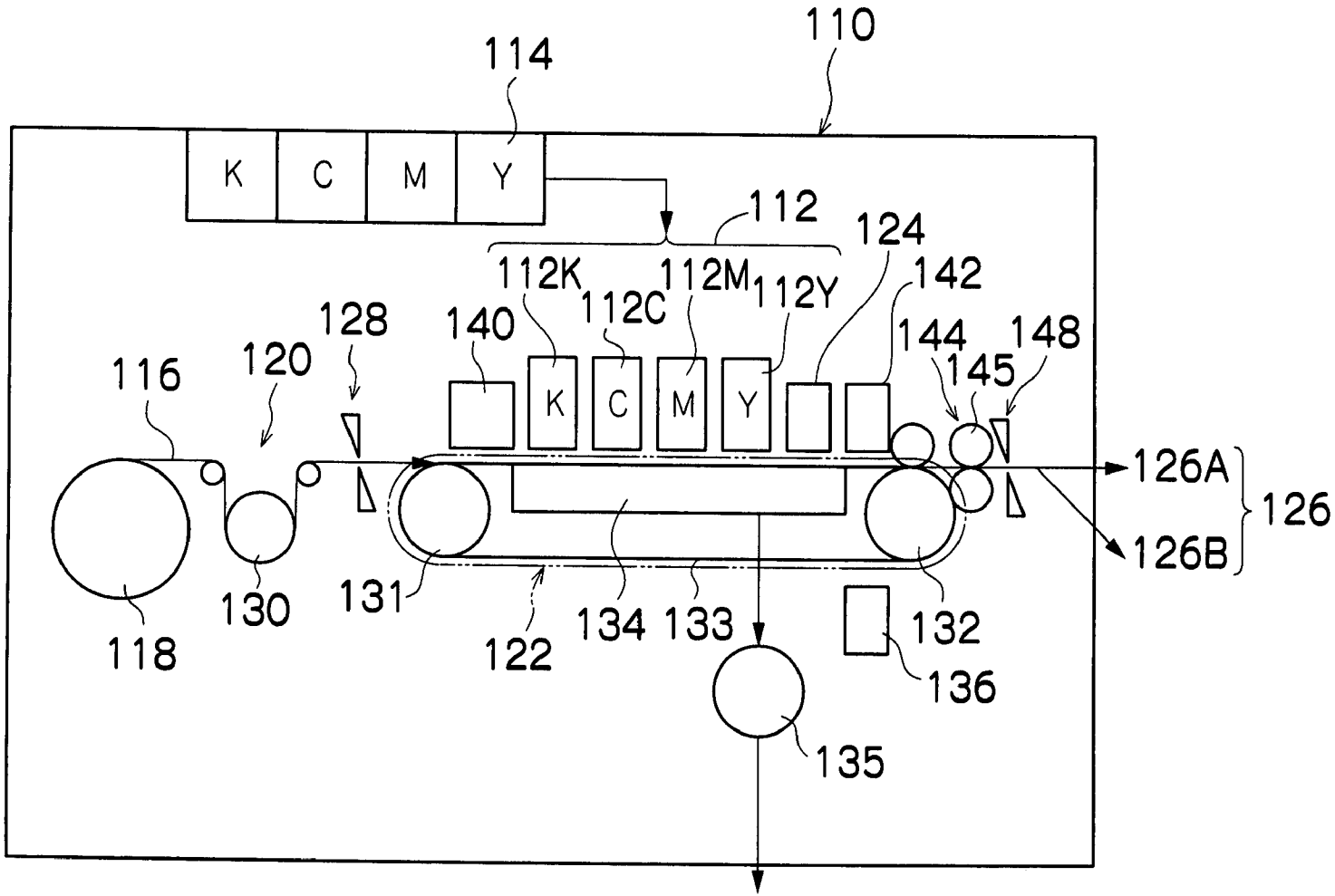
FIG. 13 is a general schematic drawing showing one example of an image forming apparatus.

FIG. 13 is a general schematic drawing of an image forming apparatus 110 comprising a liquid ejection head according to an embodiment of the present invention.

As shown in FIG. 13, the image forming apparatus 110 comprises: a liquid ejection unit 112 having liquid ejection heads 112K, 112C, 112M and 112Y for inks of colors of black (K), cyan (C), magenta (M) and yellow (Y); an ink storing and loading unit 114 for storing the inks to be supplied to the liquid ejection heads 112K, 112C, 112M and 112Y; a paper supply unit 118 for supplying a recording medium 116, such as paper; a decurling unit 120 for removing curl in the recording medium 116; a belt conveyance unit 122 disposed facing the nozzle face of the liquid ejection unit 112, for conveying the recording medium 116 while keeping the recording medium 116 flat; a print determination unit 124 for reading the ejection result (liquid droplet landing state) produced by the liquid ejection unit 112; and a paper output unit 126 for outputting printed recording medium to the exterior.

Each of the liquid ejection heads 112K, 112C, 112M, 112Y in FIG. 13 is formed of any of the liquid ejection head 50 according to the first embodiment described with reference to FIG. 1, the liquid ejection head 500 according to the second embodiment described with reference to FIG. 7, and the liquid ejection head 5000 according to the third embodiment described with reference to FIG. 9. By ejecting liquid (ink) containing a coloring agent (also referred to as "coloring material") toward the recording medium 116, from the liquid ejection heads 112K, 112C, 112M, 112Y, an image is formed on the recording medium 116.

In FIG. 13, a supply of rolled paper (continuous paper) is displayed as one example of the paper supply unit 118, but it is also possible to use a supply unit which supplies cut paper that has been cut previously into sheets. In a case where rolled paper is used, a cutter 128 is provided. The recording medium 116 delivered from the paper supply unit 118 generally retains curl. In order to remove this curl, heat is applied to the recording medium 116 in the decurling unit 120 by a heating drum 130 in the direction opposite to the direction of the curl. After decurling in the decurling unit 24, the cut recording medium 116 is delivered to the belt conveyance unit 122.

The suction belt conveyance unit 122 has a configuration in which an endless belt 133 is set around rollers 131 and 132 so that the portion of the endless belt 133 facing at least the nozzle face of the liquid ejection unit 112 and the sensor face of the ejection determination unit 124 forms a horizontal plane (flat plane). The belt 133 has a width that is greater than the width of the recording medium 116, and a plurality of suction apertures (not shown) are formed on the belt surface. A suction chamber 134 is disposed in a position facing the sensor surface of the ejection determination unit 124 and the nozzle surface of the liquid ejection unit 112 on the interior side of the belt 133, which is set around the rollers 131 and 132, as shown in FIG. 13; and this suction chamber 134 provides suction with a fan 135 to generate a negative pressure, thereby holding the recording medium 116 onto the belt by suction. The belt 133 is driven in the clockwise direction in FIG. 13 by the motive force of a motor (not shown) being transmitted to at least one of the rollers 131 and 132, which the belt 133 is set around, and the recording medium 16 held on the belt 133 is conveyed from left to right in FIG. 13. Since ink adheres to the belt 133 when a marginless print or the like is formed, a belt cleaning unit 136 is disposed in a predetermined position (a suitable position outside the print region) on the exterior side of the belt 133. A heating fan 140 is provided on the upstream side of the liquid ejection unit 112 in the paper conveyance path formed by the belt conveyance unit 122. This heating fan 140 blows heated air onto the recording medium 116 before printing, and thereby heats up the recording medium 116. Heating the recording medium 116 immediately before printing has the effect of making the ink dry more readily after landing on the paper.

Figure 14:
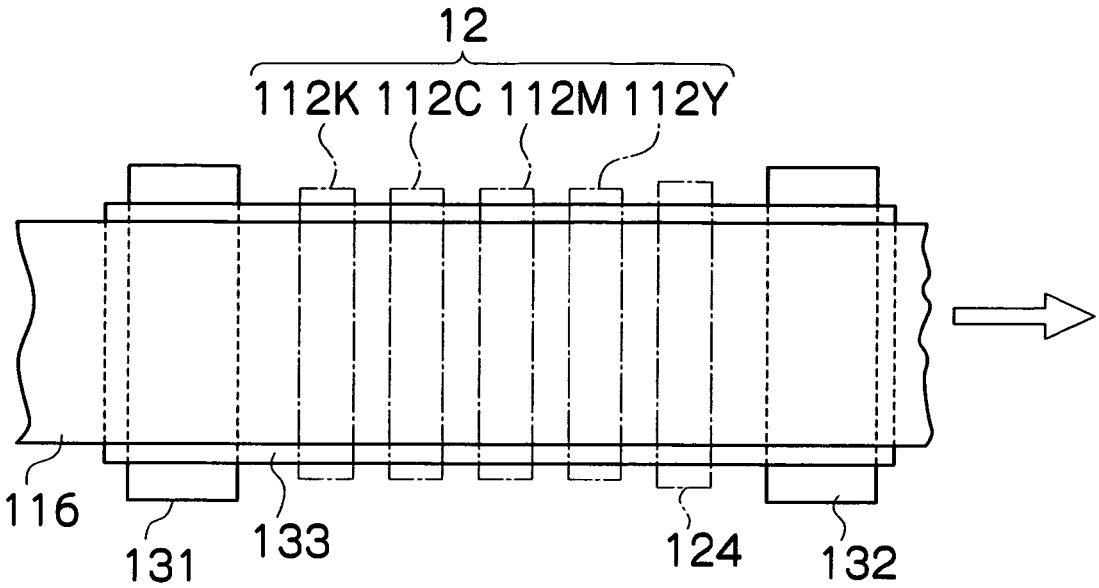
FIG. 14 is a principal plan diagram showing a liquid ejection head in the image forming apparatus, and the peripheral region of same.

FIG. 14 is a principal plan diagram showing the liquid ejection unit 112 of the image forming apparatus 110, and the peripheral region thereof.

As shown in FIG. 14, the liquid ejection unit 112 is composed of so-called "full line heads" in which line heads having a length corresponding to the maximum paper width are arranged in a direction (main scanning direction) that is perpendicular to the medium conveyance direction (sub-scanning direction). More specifically, the liquid ejection heads 112K, 112C, 112M and 112Y are line heads which each have a plurality of nozzles (ejection ports) arranged through a length exceeding at least one edge of the maximum size of recording medium 116 intended for use with the image forming apparatus 110.

The liquid ejection heads 112K, 112C, 112M and 112Y of the respective ink colors are disposed in the order black (K), cyan (C), magenta (M) and yellow (Y), from the upstream side (the left-hand side in FIG. 14), following the direction of conveyance of the recording medium 116 (the medium conveyance direction). A color image can be formed on the recording medium 116 by ejecting the inks including coloring materials from the liquid ejection heads 112K, 112C, 112M and 112Y, respectively, onto the recording medium 116 while conveying the recording medium 116.

The liquid ejection unit 112, in which the full-line heads covering the entire width of the paper are thus provided for the respective ink colors, can record an image over the entire surface of the recording medium 116 by performing the action of moving the recording medium 116 and the liquid ejection unit 112 relatively to each other in the medium conveyance direction (sub-scanning direction) just once (in other words, by means of a single sub-scan). Higher-speed printing is thereby made possible and productivity can be improved in comparison with a shuttle type head configuration in which an ink ejection head moves reciprocally in a direction (main scanning direction) which is perpendicular to the medium conveyance direction (sub-scanning direction).

The terms main scanning direction and sub-scanning direction are used in the following senses. More specifically, in a full-line head comprising rows of nozzles that have a length corresponding to the entire width of the recording medium, "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording medium relatively to each other. The direction in which sub-scanning is performed is called the sub-scanning direction. Consequently, the conveyance direction of the recording medium is the sub-scanning direction and the direction perpendicular to same is called the main scanning direction.

Although a configuration with the four standard colors, K, C, M and Y, is described in the present embodiment, the combinations of the ink colors and the number of colors are not limited to those of the present embodiment, and light and/or dark inks can be added as required. For example, a configuration is possible in which ink ejection heads for ejecting light-colored inks such as light cyan and light magenta are added.

As shown in FIG. 13, the ink storing and loading unit 114 has ink tanks for storing the inks of the colors corresponding to the liquid ejection heads 112K, 112C, 112M and 112Y, and the ink tanks are connected to the liquid ejection heads 112K, 112C, 112M and 112Y through channels (not shown).

The ejection determination unit 124 has an image sensor (line sensor, or the like) for capturing an image of the ejection result of the liquid ejection unit 112, and functions as a device to check for ejection defects such as blockages of the nozzles in the liquid ejection unit 112 on the basis of the image read in by the image sensor.

A post-drying unit 142 is provided at a downstream stage from the ejection determination unit 124. The post-drying unit 142 is a device for drying the printed image surface, and it may comprise a heating fan, for example. A heating and pressurizing unit 144 is provided at a stage following the post-drying unit 142. The heating and pressurizing unit 144 is a device which serves to control the luster of the image surface, and it applies pressure to the image surface by means of a pressure roller 145 having prescribed surface undulations, while heating same. Accordingly, an undulating form is transferred to the image surface.

The printed object generated in this manner is output via the paper output unit 126. In the image forming apparatus 110, a sorting device (not shown) is provided for switching the outputting pathway in order to sort the printed matter with the target print and the printed matter with the test print, and to send them to output units 126A and 126B, respectively. If the main image and the test print are formed simultaneously in a parallel fashion, on a large piece of printing paper, then the portion corresponding to the test print is cut off by means of the cutter (second cutter) 148. The cutter 148 is disposed immediately in front of the paper output section 126, and serves to cut and separate the main image from the test print section, in cases where a test image is printed onto the white margin of the image. Moreover, although omitted from the drawing, a sorter for collating and stacking the images according to job orders is provided in the paper output section 126A corresponding to the main images.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a first SOI substrate which has a first active layer, a first dielectric layer and a first supporting layer;

a second SOI substrate which has a second active layer, a second dielectric layer and a second supporting layer, the second active layer being bonded to the first supporting layer; and a nozzle which is formed between the first supporting layer and the second dielectric layer, the nozzle ejecting liquid in an ejection direction perpendicular to a thickness direction of the first SOI substrate and the second SOI substrate, a cross-sectional width of the nozzle perpendicular to the ejection direction being defined by a thickness of the second active layer.

2. The liquid ejection head as defined in claim 1, further comprising:

a pressure chamber which is formed in the first supporting layer and connects to the nozzle;

a diaphragm which is constituted by the first active layer and the first dielectric layer; and a piezoelectric element which is fixed to the first active layer.

3. The liquid ejection head as defined in claim 2, wherein:

a plurality of substrate units each of which is composed of the first SOI substrate and the second SOI substrate are mutually bonded; and the second supporting layer is formed with a recess for protecting the piezoelectric element of adjacent one of the substrate units.

4. The liquid ejection head as defined in claim 3, further comprising a flow channel which is formed in the first supporting layer and supplies the liquid to the pressure chamber.

5. An image forming apparatus, comprising the liquid ejection head as defined in claim 1, and forming an image on a prescribed recording medium by ejecting the liquid containing coloring material onto the recording medium from the liquid ejection head.

6. A method of manufacturing a liquid ejection head, comprising:

a SOI substrate preparation step of preparing a first SOI substrate having a first active layer, a first dielectric layer and a first supporting layer, and a second SOI substrate having a second active layer, a second dielectric layer and a second supporting layer;

a nozzle formation step of forming a first recess in the second active layer by etching the second active layer using the second dielectric layer as an etch stop layer, the first recess corresponding to a nozzle which ejects liquid in an ejection direction and has a cross-sectional width perpendicular to the ejection direction being defined by a thickness of the second active layer;

a pressure chamber formation step of forming a second recess in the first supporting layer using the first dielectric layer as an etch stop layer, the second corresponding to a pressure chamber which connects to the nozzle; and a bonding step of bonding the first supporting layer with the second active layer.

7. The method as defined in claim 6, further comprising, before the bonding step:

a first liquid resistant layer formation step of forming a first liquid resistant layer on a liquid-contacting part of the first SOI substrate by one of sputtering and chemical vapor deposition; and a second liquid resistant layer formation step of forming a second liquid resistant layer on a liquid-contacting part of the second SOI substrate by one of sputtering and chemical vapor deposition.

* * * * *